US006755104B2

(12) United States Patent
Grant

(10) Patent No.: US 6,755,104 B2
(45) Date of Patent: Jun. 29, 2004

(54) STRIPPER PLATE SUPPORTING ASSEMBLY

(76) Inventor: David S. Grant, 2413 Carter Rd., Moscow Mills, MO (US) 63362

( * ) Notice: Subject to any disclaimer, the term of this patent is extended or adjusted under 35 U.S.C. 154(b) by 0 days.

(21) Appl. No.: 10/186,510

(22) Filed: Jul. 1, 2002

(65) Prior Publication Data

US 2004/0000223 A1 Jan. 1, 2004

(51) Int. Cl.[7] ..... B26D 7/00
(52) U.S. Cl. ..... 83/140; 83/698.31; 411/140
(58) Field of Search ..... 83/698.11, 698.31, 83/128, 140, 143, 684; 411/140, 997, 962, 115

(56) References Cited

U.S. PATENT DOCUMENTS

| | | | | | |
|---|---|---|---|---|---|
| 404,370 | A | | 5/1889 | Van Nest | 411/140 |
| 438,161 | A | | 10/1890 | Huber | 411/356 |
| 727,716 | A | | 5/1903 | Uren | 411/140 |
| 969,434 | A | * | 9/1910 | Wilt | 411/962 |
| 1,098,790 | A | | 6/1914 | Farrell | 411/140 |
| 1,110,511 | A | | 9/1914 | Ratcliff | 411/140 |
| 1,139,225 | A | | 5/1915 | Pursselley | 411/140 |
| 1,246,631 | A | * | 11/1917 | Macy | 411/962 |
| 1,383,630 | A | | 7/1921 | Hoagland | 407/73 |
| 1,612,128 | A | * | 12/1926 | Kaczmarek | 411/115 |
| 1,683,501 | A | | 9/1928 | Tobeler | 83/143 |
| 1,829,293 | A | | 10/1931 | Olson | 411/140 |
| 2,336,767 | A | | 12/1943 | Ash | 301/35.625 |
| 2,371,565 | A | | 3/1945 | Whistler et al. | 83/123 |
| 2,763,325 | A | * | 9/1956 | Willous | 83/140 |
| 3,140,630 | A | | 7/1964 | Wolf | 83/140 |
| 3,418,839 | A | | 12/1968 | Hlavac | 72/344 |
| 3,589,226 | A | | 6/1971 | Shadowens, Jr. | 83/143 |
| 3,673,902 | A | | 7/1972 | Strobel | 83/133 |
| 3,733,946 | A | | 5/1973 | Davis | 83/129 |
| 4,789,287 | A | | 12/1988 | Le | 411/107 |
| 4,836,071 | A | * | 6/1989 | Ersoy | 83/140 |
| 4,993,295 | A | | 2/1991 | Dacey, Jr. | 83/140 |

* cited by examiner

*Primary Examiner*—Stephen Choi
(74) *Attorney, Agent, or Firm*—Grace J. Fishel

(57) ABSTRACT

A stripper plate supporting assembly has a stripper spool unit including a stripper spool and retaining screw for supporting the stripper plate in a die press in a manner that the stripper plate may be removed from a die set without removing the die set from the press. The stripper spool has a shank with at least one spring biased pin in its flat end. At least one opening or socket is provided in the stripper plate for receiving the pin and preventing the stripper spool from turning with the retaining screw.

8 Claims, 3 Drawing Sheets

STRIPPER PLATE SUPPORTING ASSEMBLY

BACKGROUND OF THE INVENTION

1. Field of the Invention

The present invention relates to an assembly for supporting a stripper plate in a die set such that the stripper plate can be easily assembled and removed.

2. Brief Description of the Prior Art

Die assemblies include upper and lower die shoes. The lower shoe is adapted to be mounted on the bed of a punch press and the upper shoe is adapted to be mounted to a power ram for reciprocating the upper die shoe toward and away from the lower die shoe. Stamping a work piece is performed by suitable dies and punches mounted on the die shoes. One or more stripper plates complete the die set into a die assembly.

Stripper plates have long been used in die assemblies to strip the material being worked from the punches but stripper plates may perform other functions in addition to traditional stripping operations. These additional functions include retaining forming inserts, functioning as pressure devices, serving as guides for weak or thin punches, flattening parts, and so forth.

In the past, it has been customary, to mount the stripper plate on the die set by means of shoulder bolts extending through the upper or lower die shoe and screwing in to the stripper plate. The stripper plate is spring biased on the stripper bolts with springs that surround the shoulder bolts or are otherwise spaced between the stripper plate and the respective die shoe. During the operation of the press, breakdowns, the need to change punches, and the like, and other difficulties often require removal of the stripper plate. Stripper bolts that screw into the stripper plate are inconvenient as they require removing the die set from the press in order to remove the stripper plate.

Various means have been proposed to facilitate the removal of the stripper plate without removing the die set from the press. One such system makes use of a retaining screw which is threaded from the face of the stripper plate into a stripper spool, but with this system the stripper spool tends to spin with the retaining screw making installation and removal of the stripper plate difficult.

Flats have been provided on the stripper spool for the purpose of holding the spool while the retaining screw is threaded into the spool; however, lack of space in the die set makes access to the wrench flats very difficult or impossible. Spikes have been provided on the spool for digging into the rear face of the stripper plate to keep the spool from spinning with the retaining screw. When the stripper plate is reinstalled, the holes in the rear face of the stripper plate may not line up with the spikes. In time the spikes form a groove in which the spikes spin along with the spool. Another solution provides a projection on the head of the stripper spool which prevents the spool from rotating with the retaining screw but this requires the die shoe to be machined with an odd-shaped counterbore for receipt of the projection.

BRIEF SUMMARY OF THE INVENTION

In view of the above, it is an object of the present invention to provide a stripper spool unit for supporting a stripper plate in a manner that the stripper plate can be removed for servicing the die without removing the die from the press. Other objects and features of the invention will be in part apparent and in part pointed out hereinafter.

In accordance with the present invention, a stripper plate supporting assembly has a stripper spool with a shank, a head and a flat end remote from the head, with a drilled and tapped longitudinal hole extending inwardly from the flat end. A bore is provided in the flat end spaced from the drilled and tapped hole for receipt of a pin which is spring biased to normally project a free end of the pin beyond the flat end of the stripper spool. It will be understood that the terms "a bore" and "a pin" as used herein includes the plural (i.e., one or more bores and/or one or more pins).

The assembly further includes a die set with a bore having a diameter for close sliding fit with the stripper spool shank and a shoulder for limiting the length of relative travel between the stripper plate and the die set. A stripper plate is provided with a bore in axial alignment with the drilled and tapped hole in the stripper spool. The stripper plate additionally has an opening or socket spaced from the bore for receipt of the free end of the pin. It will be understood that the term "an opening" includes the plural (i.e., one or more openings).

A retaining screw extends through the stripper plate bore and threads into the drilled and tapped hole. The retaining screw coacts with the stripper spool to hold and support the stripper plate in position against the flat end of the stripper spool, with the free end of the pin received in the opening or socket in the stripper plate preventing the stripper spool from turning with the retaining screw, allowing the stripper plate to be easily and quickly positioned on and removed from the die set without removing the die set from the press.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
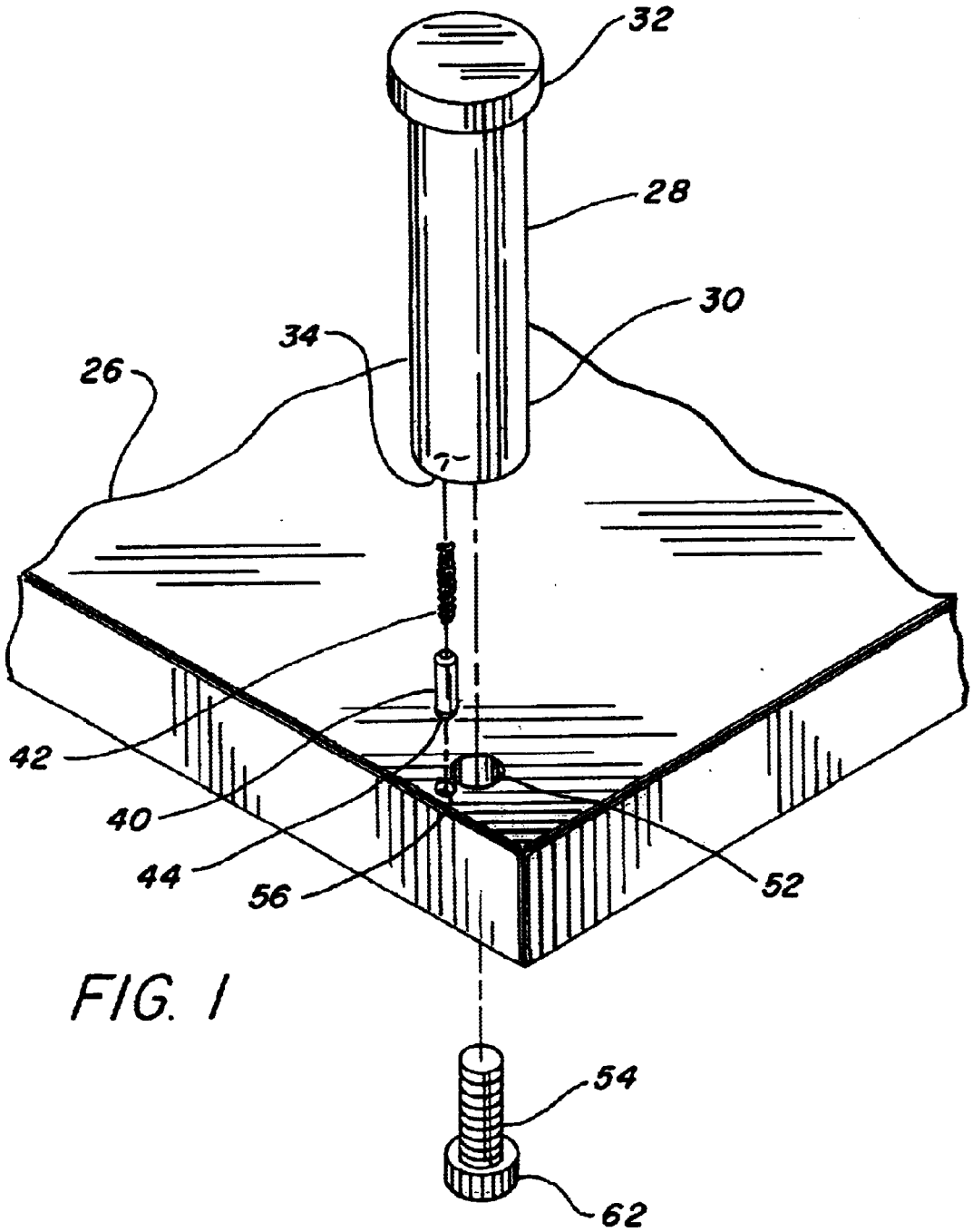
FIG. 1 is an exploded perspective view of a stripper spool and retaining screw unit in accordance with the present invention.
Figure 2:
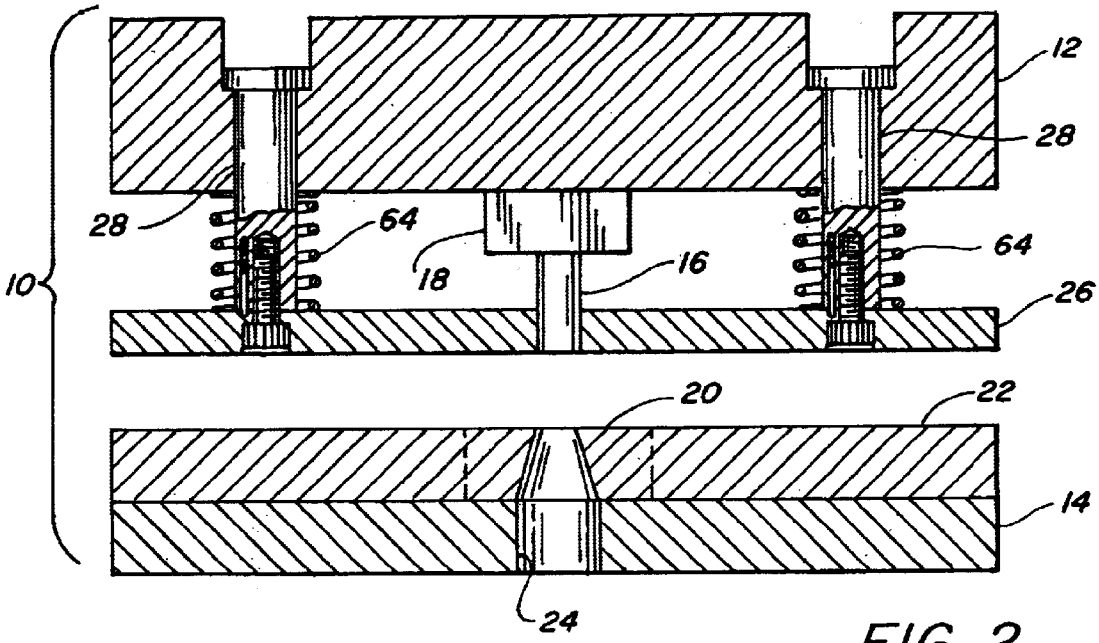
FIG. 2 is a side elevation in section of a stripper plate supporting assembly in accordance with the present invention.

Referring to FIG. 2 more particularly by reference character, reference number 10 refers to a stripper plate supporting assembly in accordance with the present invention. Assembly 10 includes an upper die shoe 12 and a lower die shoe 14. Lower die shoe 14 is adapted to be mounted to the bed of a punch press (not shown) and upper die shoe 12 is adapted to be mounted to a power ram (not shown). Attached to upper and lower die shoes 12, 14 are one or more punches 16 or other forming tools held by punch plates 18 which cooperate with one or more corresponding dies 20 held by die plates 22 associated with the opposite die shoe. In some instances, die plates 22 may be integral with dies 20. Clearance holes 24 may be provided in the die shoe bearing die 20 for slugs to drop after they are punched out of a work piece.

One or more spring biased stripper plates 26 supported on stripper spools 28, more particularly described below, complete assembly 10. The term "stripper plate" as used herein includes floating members that strip the material being worked from the forming tools as well as floating members that retain forming inserts, function as pressure devices, serve as guides, flatten the parts and so forth. Stripper plate 26 overlies a sheet of stock (not shown) to be worked. It is understood that the stock is fed and indexed into the press, and the usual provisions are made for maintaining alignment of the stripper plates 26, punches or other forming tools 16, dies 20 and the stock.

With reference to FIGS. 1–3 and 5, each stripper spool 28, a pair of which are shown in FIG. 2, has a shank 30, a head 32 and a flat end 34 remote from the head. A drilled and tapped longitudinal hole 36 extends inwardly from flat end 34. A closed-ended longitudinal bore 38, spaced from drilled and tapped hole 36, is provided in flat end 34. A pin 40 is received in bore 38 and held by a spring 42 to normally project a free end 44 of pin 40 beyond flat end 34. While only one bore 38 and one pin 40 is shown in the drawings, it will be apparent that more than one of each may be used.

Figure 3:
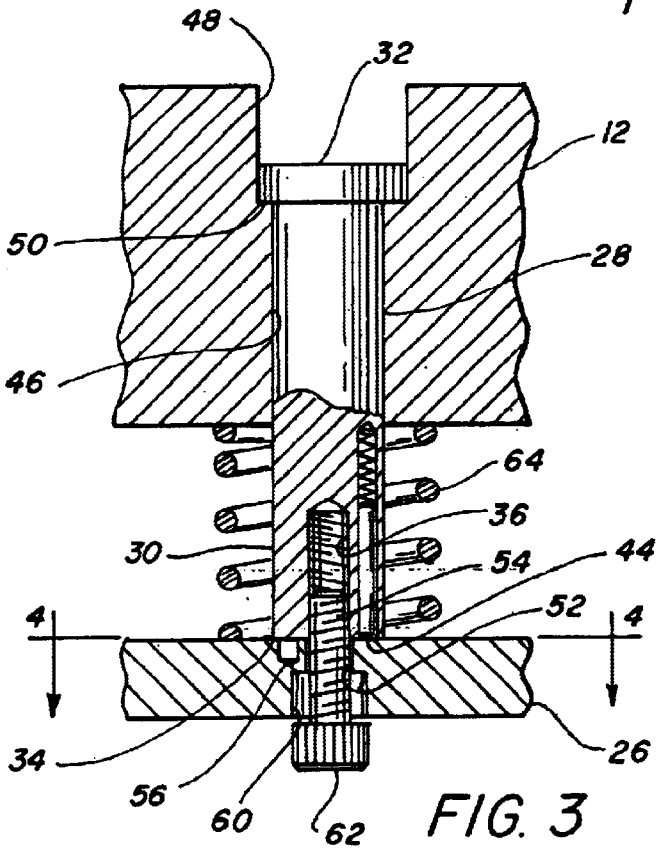
FIG. 3 is a side elevation in section showing the retaining screw being threaded into the stripper spool for supporting a stripper plate.
Figure 5:
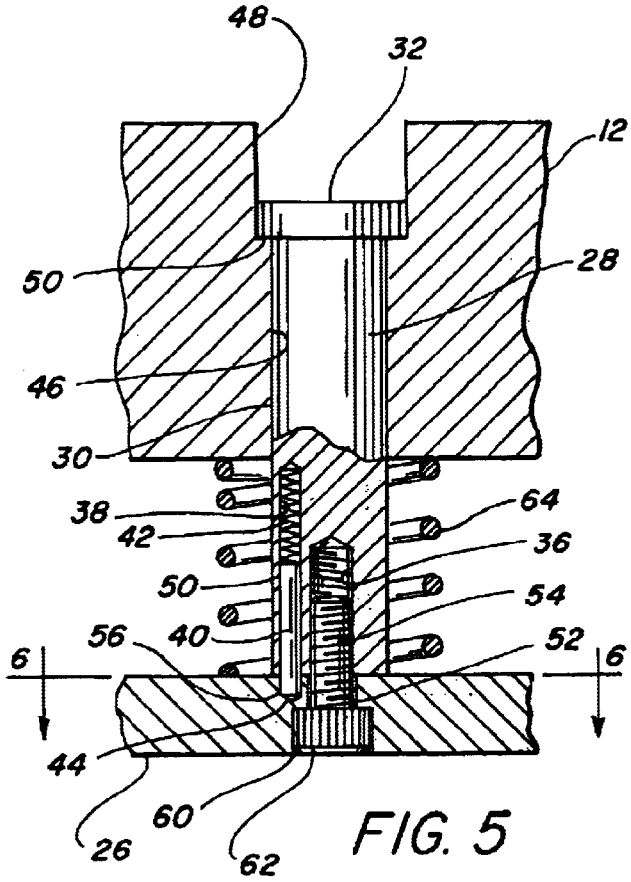
FIG. 5 is a side elevation in section showing the retaining screw tightened in the stripper spool for supporting the stripper plate; and, FIG. 6 is a section taken along line 6—6 in FIG. 5.

Stripper spools 28 are supported by one of die shoes 12, 14. In some die sets, stripper plates 26 are provided on upper die shoe 12 only. In other die sets, stripper plates 26 are provided on lower die shoe 14, while in more complex die sets, stripper plates 26 may be provided on both shoes. As seen in FIGS. 3 and 5, a bore 46 with a diameter having a close sliding fit with shank 30 is formed in upper die shoe 12 and is counterbored, as at 48, at a side of upper die shoe 12 remote from stripper plate 26, to a depth above head 32 equal to the travel which stripper plate 26 is to have relative to the die set during the die press cycle. Counterbore 48 has a diameter such as to provide a smooth sliding fit with head 32 of stripper spool 28 with the bottom of counterbore 48 forming a shoulder 50 stopping movement.

Stripper plates 26 have a bore 52 in axial alignment with each drilled and tapped hole 36 in stripper spool 28 for receipt of a retaining screw 54. An opening or socket 56, spaced from bore 52, is provided on the back face of stripper plate 26 for receipt of spring biased pin 40. While only one opening or socket 56 is shown in the drawings, it will be apparent that more than one may be provided. Retaining screw 54 may be of the ordinary Allen or similar type or flat-headed if stripper plate 26 is thin. A counterbore 60 may be provided in the face of stripper plate 26 for receipt of a head 62 of retaining screw 54. Retaining screw 54 is inserted through bore 52 and into engagement with the threads in drilled and tapped hole 36 and tightened to hold stripper plate 26 tightly and firmly against flat end 34 of stripper spool 28, with head 62 of retaining screw 54 within counterbore 60.

Figure 4:
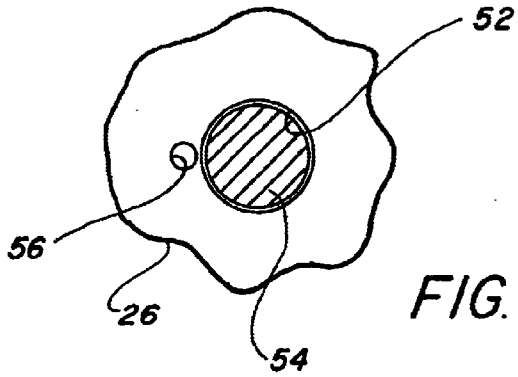
FIG. 4 is a section taken along line 4—4 in FIG. 3.
Figure 6:
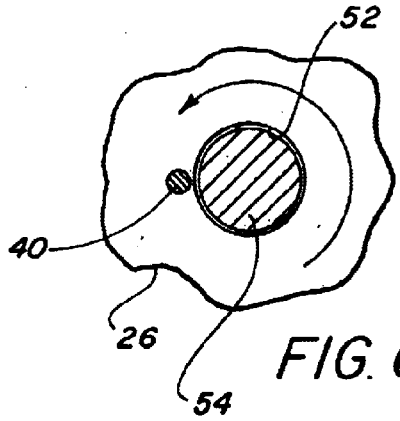

As illustrated in FIGS. 3–4, initially spring biased pin 40 is not in opening or socket 56 and stripper spool 28 tends to rotate with retaining screw 54 when it is threaded into stripper spool 28. As stripper spool 28 rotates, pin 40 slides over the back side of stripper plate 26 until it is caught in opening or socket 56 as shown in FIGS. 5–6 stopping stripper spool 26 from further rotation, thereby ensuring that retaining screw 54 may be easily tightened and loosened within and relative to stripper spool 28 and allowing stripper plate 26 to be easily and quickly positioned on and removed from the die set without removing the die set from the press. This is convenient, for example, if a punch should break and require replacement, sharpening, removal or altering in position. When this happens, all that is necessary to change or dress the punch is to remove the several retaining screws 54 which secure stripper plate 26 to stripper spools 28. When this is done, stripper plate 26 can be removed to expose the punches so that they can be replaced, sharpened or removed as may be required.

Stripper plate 26 is resiliently biased from the associated die shoe 12, 14 on springs 64. Springs 64 may be held against lateral deflection in a number of ways which are unrelated to the present invention. For example, springs 64 may surround stripper spools 28 as shown in FIGS. 2, 3 and 5. In other embodiments, one end of springs 64 may be received in sockets provided in the die with the other end seated on trunnions rising from the stripper plate and so forth. Springs 64 urge stripper spools 28 into engagement with shoulders 50 when upper and lower die shoes 12, 14 are at their greatest point of separation at the beginning of a stamping operation. Heads 32 of stripper spools 28 slide in counterbores 48 during the final portion of the stamping operation.

Upon completion of the punching operation, the ram, together with upper shoe 12 rises. In the die set shown in FIG. 2, stripper plate 26 and punch 16 are mounted on upper die shoe 12 and the work piece tends to cling to rising punch 16 but upward movement of the work piece is prevented by stripper plate 26. Springs 64, through heads 32, hold stripper plate 26 down in engagement with the work piece until the punches leave the work piece and until heads 32 seat on shoulders 50. Thereafter, further upward movement of the ram and upper die shoe 12 elevates stripper plate 26, punches 16 and the parts of the stripper spring unit in unison, thereby freeing the work piece for removal and replacement. It will be understood that stripper plate 26 functions in mirror image to that described above when it is mounted on lower die shoe 14.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A stripper plate supporting assembly for a die press comprising:

a stripper spool having a shank, a head and a flat end remote from said head, a drilled and tapped longitudinal hole extending inwardly from said flat end, a closed-ended bore in the flat end spaced from the drilled and tapped hole, a pin received in said bore is spring biased to normally project a free end of the pin beyond the flat end, a die set with a bore having a diameter for close sliding fit with said stripper spool shank and a shoulder for limiting the length of relative travel between said stripper plate and said die set, a stripper plate with a bore in axial alignment with said drilled and tapped hole in said stripper spool, a closed ended opening or socket spaced from the bore for seated receipt of the free end of the pin in a clockwise and counterclockwise direction, a retaining screw extending through said stripper plate bore and threading into said drilled and tapped hole, said retaining screw coacting with said stripper spool to hold and support said stripper plate in position against said flat end of the stripper spool, said free end of the pin received in the opening or socket in the stripper plate preventing the stripper spool from turning clockwise or counterclockwise with the retaining screw.

2. The assembly of claim 1 wherein the die set comprises an upper die shoe and a lower shoe and the stripper plate is supported from and spring biased away from one of said die shoes.

3. The assembly of claim 2 wherein the stripper plate is supported from and spring biased away from the upper die shoe.

4. The assembly of claim 2 wherein the spring for biasing the pin and the spring for biasing the stripper plate are coil springs.

5. A stripper plate supporting assembly comprising:

a stripper spool having a shank, a head and a flat end remote from said head, a drilled and tapped longitudinal hole extending inwardly from said flat end, a closed-ended longitudinal bore in the flat end spaced from the drilled and tapped hole, a pin received in said bore is spring biased to normally project a free end of the pin beyond the flat end, a die set with a bore having a diameter for close sliding fit with said stripper spool shank and a counterbore in said die set remote from said stripper plate and having a diameter for close sliding fit with said spool head and a depth greater than the axial length of said spool head by the length of relative travel between said stripper plate and said die set, a stripper plate with a bore in axial alignment with said drilled and tapped hole in said shank, a closed ended opening or socket spaced from the bore for seated receipt of the free end of the pin in a clockwise or counterclockwise direction, a retaining screw extending through said stripper plate bore and threading into said drilled and tapped hole in the stripper spool, said retaining screw coacting with said stripper spool to hold and support said stripper plate in position against said flat end of the stripper spool, said free end of the pin received in the opening or socket in the stripper plate preventing the stripper spool from turning clockwise or counterclockwise with the retaining screw.

6. The assembly of claim 5 wherein the die set comprises an upper die shoe and a lower shoe and the stripper plate is supported from and spring biased away from one of said die shoes.

7. The assembly of claim 6 wherein the stripper plate is supported from and spring biased away from the upper die shoe.

8. The assembly of claim 6 wherein the spring for biasing the pin and the spring for biasing the stripper plate are coil springs.

* * * * *